US007377884B2

(12) United States Patent
Schopf

(10) Patent No.: US 7,377,884 B2
(45) Date of Patent: May 27, 2008

(54) EXERCISE APPARATUS

(76) Inventor: John Michael Schopf, 19 Silvertop St Frankston North, Frankston North, Victoria (AU) 3200

( * ) Notice: Subject to any disclaimer, the term of this patent is extended or adjusted under 35 U.S.C. 154(b) by 0 days.

(21) Appl. No.: 10/487,446

(22) PCT Filed: Aug. 28, 2002

(86) PCT No.: PCT/AU02/01176

§ 371 (c)(1),
(2), (4) Date: Feb. 23, 2004

(87) PCT Pub. No.: WO03/018138

PCT Pub. Date: Mar. 6, 2003

(65) Prior Publication Data

US 2005/0124470 A1 Jun. 9, 2005

(51) Int. Cl.
*A63B 21/06* (2006.01)
*A63B 21/08* (2006.01)

(52) U.S. Cl. ..... 482/97; 482/100; 482/136; 482/138; 482/142

(58) Field of Classification Search ..... 482/72, 482/92–100, 135–137, 138, 142
See application file for complete search history.

(56) References Cited

U.S. PATENT DOCUMENTS 231,869 A * 8/1880 Tuttle ..... 482/96
684,688 A * 10/1901 Herz ..... 482/97
2,252,156 A * 8/1941 Bell ..... 74/99 R
2,455,548 A * 12/1948 Bell ..... 482/96
2,642,288 A * 6/1953 Bell ..... 482/96
2,924,456 A * 2/1960 Miller ..... 482/96
3,563,542 A 2/1971 Wellman et al.
3,905,599 A 9/1975 Mazman
4,093,213 A * 6/1978 Coker et al. ..... 482/98
4,354,675 A * 10/1982 Barclay et al. ..... 482/98
4,511,137 A 4/1985 Jones
4,546,970 A * 10/1985 Mahnke ..... 482/98
4,632,390 A * 12/1986 Richey ..... 482/96
4,666,152 A 5/1987 Jones
4,709,920 A * 12/1987 Schnell ..... 482/100
4,807,874 A 2/1989 Little
4,834,396 A * 5/1989 Schnell ..... 482/97
4,878,663 A * 11/1989 Luquette ..... 482/100

(Continued)

FOREIGN PATENT DOCUMENTS

AU 198657830 A1 11/1986

(Continued)

*Primary Examiner*—Jerome Donnelly
*Assistant Examiner*—Victor K. Hwang
(74) *Attorney, Agent, or Firm*—Kirk Hahn

(57) ABSTRACT

There is provided an exercise machine in which resistance to movement of an actuation member, such as a handle, is provided and that resistance is able to be varied through the course of a single repetition of a series of repetitive exercises. The variation of resistance with distance along the movement path of the actuation member is, in a preferred embodiment, able to be changed by the selection and fitting of a component having a contoured surface, with which a follower means in the machine interacts to vary the resistance. There is also provided a multi-function exercise machine, that lends itself well to provision of the variable resistance feature.

10 Claims, 10 Drawing Sheets

U.S. PATENT DOCUMENTS

| | | | | | |
|---|---|---|---|---|---|
| 4,949,958 | A | * | 8/1990 | Richey | 482/96 |
| 4,957,281 | A | | 9/1990 | Christolear, Jr. | |
| 4,982,956 | A | * | 1/1991 | Lapcevic | 482/100 |
| 5,102,121 | A | | 4/1992 | Solow et al. | |
| 5,356,360 | A | * | 10/1994 | Johns | 482/99 |
| 5,447,480 | A | * | 9/1995 | Fulks | 482/99 |
| 5,496,238 | A | * | 3/1996 | Taylor | 482/63 |
| 5,527,249 | A | * | 6/1996 | Harris | 482/96 |
| 5,620,402 | A | * | 4/1997 | Simonson | 482/72 |
| 5,658,227 | A | | 8/1997 | Stearns | |
| 5,722,921 | A | * | 3/1998 | Simonson | 482/100 |
| 5,800,310 | A | * | 9/1998 | Jones | 482/8 |
| 5,827,158 | A | * | 10/1998 | Drecksel | 482/96 |
| 5,891,004 | A | | 4/1999 | Berry | |
| 5,897,473 | A | * | 4/1999 | Koenig | 482/97 |
| 6,019,711 | A | * | 2/2000 | Koenig | 482/97 |
| 6,030,322 | A | * | 2/2000 | Webber | 482/100 |
| 6,074,328 | A | | 6/2000 | Johnson | |
| 6,287,241 | B1 | * | 9/2001 | Ellis | 482/96 |
| 6,350,219 | B1 | | 2/2002 | Hobson | |
| 6,394,937 | B1 | * | 5/2002 | Voris | 482/139 |
| 6,652,429 | B2 | * | 11/2003 | Bushnell | 482/128 |
| 6,764,429 | B1 | * | 7/2004 | Michalow | 482/51 |
| 7,052,444 | B2 | * | 5/2006 | Webber | 482/93 |

FOREIGN PATENT DOCUMENTS

| | | | | |
|---|---|---|---|---|
| RU | 2046617 | C1 | * | 10/1995 |
| SU | 1831788 | A3 | * | 7/1995 |
| WO | WO 9325283 | A1 | * | 12/1993 |

* cited by examiner

| | | Bench Position | Floating Mount | Hole Select | Pin Set Up Point | Roller Pad | Arm extension | Swivel Grips | V Pins | Body Position | Comments |
|---|---|---|---|---|---|---|---|---|---|---|---|
| 1 | Top Rower | high | Co-axial | 10 | Back | | Out, or Locked out | | | Sit facing machine on riding bench | Use wave cam to simulate water |
| 2 | Leg Curls | High | Co-ax | 10 | Back | Outer | | | | Lie belly down facing away | Grip on to foot rests |
| 3 | Upright Curls | High | Co-ax | 15 | Front | Outer | In | | Hand Grips | Sit facing machine | Harness knees down |
| 4 | Leg Extension | High | Co-ax | 1 | Back | Outer | In | | Hand Grips | Sit facing machine | Use appropriate desired cams |
| 5 | Lower Back | High | Co-ax | 23 | Front | Outer | In | | Hand Grips | Lie on back with calves on user arms | As above |
| 6 | Leg Press | High | Co-ax | 26 | Front | Outer | In | | | Lie on back with foot on extender | Use one foot at a time. Left & right joined – use resistance increasing cam |
| 7 | Pectorals | Med | Parallel | 30 | Front | Inner | In | *Yes Down* | Safety catch | Lie facing up | Handles swivel to accommodate different arm lengths |
| 8 | Torso Twist | Med | Para | 31+16 | Front and Back | Inner | In | Yes | Safety catch | Lie facing up | Holster feet into padded mounts on bench legs |
| 9 | Thigh Abductors | Med | Para | 27 | Front | Outer | In | Yes *ankles* | | Lie on back with calves on user arms | |
| 10 | Pelvis | Med | Para | 15 | Back | Outer | In | Yes *ankles* | | As above | |
| 11 | Blades Up | Med | Para | 5 | Front | Outer | In | Yes | | Lie facing through bench gap | |
| 12 | Blades Down | Med | Para | 14 | Back | Inner | In | Yes | | Lie facing up | |
| 13 | Pecs Down | Med | Para | 22 | Back | Inner | In | Yes | | Lie facing down | |
| 14 | Shoulders | Low | Para | 4 | Front | Inner | In | Yes | | Sit with knees inside machine | |
| 15 | Side Bend | Low | Para | 4+21 | Front Back | Inner | In | Yes | | As above | |
| 16 | Lats | Low | Para | 21 | Back | Inner | In | Yes | | As above | |
| 17 | Extent Shoulder | Low | Para | 32 | Back | Inner | In | Yes | | As above | |
| 18 | Biceps | Low | Co-ax | 5 | Back | | | | | As above | Put on self adjusting upper arm rest and safety stopper. When seated grip upper arm extenders |

FIGURE 13

| | | Bench Position | Floating Mount | Hole Select | Pin Set Up Point | Roller Pad | Arm extension | Swivel Grips | V Pins | Body Position | Comments |
|---|---|---|---|---|---|---|---|---|---|---|---|
| 19 | Triceps | Low | Co-ax | 20 | Front | | | | | As above | As above |
| 20 | Cable Rower | Low | Co-ax | 19 | Front | | Extend out | | | Seated on riding bench | Cables with handles are fastened to end of arm extenders through pulleys use wave cam |
| 21 | Cable breast stroke | Low | Co-ax | 19 | Front | | Extend out | | | Lie on back facing up | Wind cable around arm extenders to adjust length use wave cam |
| 22 | Seated cable exercises | Low | Co-ax | 19 | Front | | Extend out | | | Sit on bench facing machine | As above. Use standard cam |
| 23 | Cable bench press & pull exercises | Angle high, low | Co-ax | 19 | Front | | Extend out | | | Lie on bench facing up or down | Cable allows greater freedom of movement |
| 24 | Bench Press | Angle Low | Co-ax | 30 | Back | | In | | | Lie on bench facing up | Grip arm extenders |
| 25 | 4-way neck | Angle low | Co-ax | 1 | Front | | In | | | Lie on one of four sides on bench and place head under roller pad | Hook on bench offset under one user arm |
| 26 | Calf or shoulder raises | | Co-ax | 1 | Back | | In | | Stand behind machine | | Grip arm extender |
| 27 | Squats | | Co-ax | 5 | Back | | | | Stand behind machine | | Place roller pads inside elbows |
| 28 | side winder | | Co-ax | 10 & 27 or reverse | Back Front | | In | | Stand behind machine | | Grip arm extenders and simultaneously push and pull |
| 29 | barbell bench | Angle Low | Co-ax | 5 | Back | | Out | | Barbell carrier | Lie facing up | Doubles as a standard Barbell unit |
| 30 | Cable whole body | No bench | Co-ax | 19 | Front | | Extend out | | | Stand in front of machine | Exercise arms and legs etc |
| 31 | Standing stretch | No bench | Para | 14 | Back | | Extend out | | | Stand behind machine | Grip arm extender |
| 32 | Grip | | Para | 26 | Front | Inner | In | | | Stand behind machine | Grip both arm extenders between thumbs and fingers |
| 33 | Pincer | | Para | 30 | Front | | In | | | Stand behind machine | Grip one arm extender in each arm |

FIGURE 13 (cont)

EXERCISE APPARATUS

TECHNICAL FIELD

This invention relates to apparatus for exercising, of the type in which a user interacts with one or more movable components. In particular, the invention concerns such apparatus in which there is provided a variable resistance to motion of one or more of said movable components.

BACKGROUND ART

There are numerous different methods for exercising muscles of the human body. Many involve no requirement for equipment at all, simply involving a person following a defined movement that concentrates loads on particular muscle groups. Many methods, however, do involve equipment, and for a range of reasons—to enable larger forces to be obtained, to better target particular muscle groups than ordinary exercise regimes can do, and to allow more easy regulation of progress from easy exercise to more demanding. One popular exercise method involves the use of "free" weights, such as barbells and so-called "dumb-bells". The use of free weights is desirable for such reasons as these.

In addition to the advantages which free weights offer, there are also several disadvantages. First, it is difficult to isolate some muscle groups with free weights because of the awkward angle at which the free weight must be moved during the exercise. Additionally, many lifts involving free weights require the use of a "spotter", i.e. an assistant. If the lifter is unable to complete the lift, the spotter must step in and quickly assist in the lift to prevent physical harm from being incurred by the lifter. Nowhere is this more important than in bench presses, in which a barbell is lifted above the body of a lifter lying on his (or her) back. If the lifter is unable to lift the weights and no spotter is available, the barbell can land on the lifter's throat, causing serious injury or even death.

Because many individuals wish to work out at home or wish to avoid the use of a spotter, there has been a marked increase in the popularity of mechanical devices in which one or more movable parts are moved by the user against resistance generated by, for example, weights, springs, or even the user's own weight. Multi-function equipment in particular has proven popular, due to its ability to provide a range of exercises, targeted to develop particular muscle groups. As with free weights, such machines when used continuously or repetitively involve the expenditure of effort and so also aid the improvement of fitness (eg heart and lung function).

Such equipment most usually includes at least one weight stack which engages a cable which is in turn pulled by the user. Typically this is accomplished by an elongate metal shaft with a plurality of holes which extends through the stack of weights. A locking pin is inserted into one of the holes and all weights above the locking pin are lifted with each pull on the cable. The cable may be pulled directly by a user, or alternatively the user may move a mechanical component which is itself linked to the cable directly or indirectly via various types of mechanisms.

One disadvantage of such equipment, however, is that the resistance felt by a user often varies throughout the normal range of movement, often in a way that is not ideal for the user. For example, some equipment tends to focus the exertion of each lift at the beginning of each muscle movement. In other words, once the cable has begun to move the associated weights, the effort involved with moving the weights through the remainder of the repetition decreases significantly. This can affect muscle use and development. For this reason, many serious body builders will not use multi-function machines. This problem also limits the ability of the user to focus on a particular area of weakness along the muscle's movement. For example, a user may determine that he is not as strong as desired in the last 60 degrees of a biceps curl when using free weights or may desire to tone his biceps to provide a more rounded curve. With the present multi-function machines and even single station cable-based exercise machines, strengthening or toning as desired can be extremely difficult.

The available multi-function exercise machines also have a number of other problems. For example, some machines will only allow a user to perform a few different exercises, e.g. they may only work the arms or legs, often in only a limited number of ways. Others are overly complex and costly. Thus there is a need for an improved multi-function exercise apparatus that addresses these problems.

The problem of providing resistance to movement of a member of an exercise apparatus, with that resistance varying along the path of the member in a desired way, has been recognized, and addressed in various ways. One class of machine is based on a weight being supported on a member rotatably mounted on a shaft journalled in a frame, the shaft being rotated by a lever or other mechanism through the effort of a user. A starting position (i.e. lateral displacement from the shaft axis) of the weight can be varied so that the starting torque applied to the shaft to resist the user-generated torque, and the nature of its variation as the shaft is rotated, can be adjusted to a degree. One example of this approach is disclosed by Hobson (U.S. Pat. No. 6,350,219). A problem with such devices is that only a limited degree of control of resistance variation is possible.

An alternative approach, and the one thought to be the most commonly used, is thought to be that exemplified by such devices as those of Kasigkeit (Australian patent application 57830/86), Johns (U.S. Pat. No. 5,356,360), and Solow (U.S. Pat. No. 5,102,121), in which a cable or chain extends from a weight stack over a rotatable cam which in turn is rotated (directly or via one or more intermediate members) by a user. See also U.S. Pat. Nos. 4,511,137, 4,666,152, 4,807,874, 4,957,281 and European Patent 0391315, all of which are examples of such cam-based exercise machines. The torque applied by the weight to resist its rotation depends on the shape of the cam. This approach is in reality a variation on the previous one, in that the resisting torque applied to a rotating member depends on the distance from that member's axis at which a constant force is applied. There are limitations to the nature of the resistance variation that can be provided in this way. For example, variation in resistance over a very short distance is difficult to provide. There are also limitations to the ease with which the nature of the resistance variation can be changed at will for a given exercise or to suit a different exercise.

The exercise apparatus disclosed herein addresses the problems of multi-function machines set out above, while allowing a large number of different exercises to be carried out. Moreover, the machine lends itself to being modified to provide modulated resistance for improved workout for various muscle groups. "Modulated" here means that the resistance to movement felt by a user of apparatus during each repetition of a particular exercise (or part of an exercise) varies with movement along the stroke.

Other types of exercise apparatus provide a degree of variation of resistance simply through progressive change of relative orientation of their parts during use. An example is the apparatus of Stearns (U.S. Pat. No. 5,658,227), which uses an arrangement of pin-jointed links to provide movement, but with variation of resistance not being a particular objective. U.S. Pat. No. 6,074,328 also discloses a machine of this class. The modulation of resistance discussed herein is to be understood as variation that is additional to and distinct from such variation, but need not necessarily be of smaller magnitude.

A mechanical arrangement is disclosed herein which can provide modulation of the resistance felt by a user of exercise apparatus in the above sense. The arrangement also enables the nature of that variable (modulated) resistance to itself be changed conveniently.

The multifunction exercise apparatus disclosed herein lends itself to use of the said arrangement, and is preferably provided with it. However, the exercise apparatus is also considered to offer a useful alternative to others in the market when the variable resistance arrangement is disabled or even excluded altogether.

Moreover, the variable resistance arrangement disclosed is also applicable in types of exercise apparatus other than the preferred one here disclosed.

DISCLOSURE OF THE INVENTION

The invention provides an exercise apparatus comprising: a frame; a first movable member comprising a lever pivotably mounted to said frame; actuation means mounted in bearing means to be pivotable about a horizontal axis in response to a defined movement of a user of said apparatus and linked to said first movable member so that pivoting movement of said actuation means pivots said lever; a second movable member comprising a carriage movable up and down along a path defined by linear guides comprised in said frame; and resistance generating means for resisting movement of said second movable member comprising weights positionable on said carriage; wherein: one of said first and second movable members includes an elongate cam having a shaped cam surface extending between opposing ends of said cam and the other of said first and second movable members includes a cam follower that in response to movement of said actuation means traverses a path along said shaped cam surface between said opposing ends so that said second movable member moves along said path defined by said guides and so that said user experiences a defined pattern of resistance variation during execution of said defined movement said pattern being dependent on the shape of said shaped cam surface.

Preferably, said cam follower traverses said path on said cam surface by rolling thereon. This minimizes frictional resistance.

In one embodiment, the elongate cam may be removable by a user from said apparatus and replaceable by a further cam having a differently shaped surface so as to provide a different pattern of said resistance variation.

In another embodiment, the shaped surface of said elongate cam is one of a plurality of shaped surfaces on said elongate cam and wherein each of said plurality of shaped surfaces is selectable by a user for contact with said cam follower. In this embodiment, said cam may comprise a fixed part and a movable part, said movable part bearing said plurality of surfaces and being rotatable about said fixed member whereby to position a selected one of said plurality of surfaces for contact with said cam follower. The movable part may include a plurality of radially and lengthwise extending formations and wherein each said formation bears one of said plurality of shaped surfaces. In this preferred embodiment, it is possible to alter the variation of resistance during an exercise stroke without removing and replacing the cam.

Preferably, said actuation means is linked to said lever by an elongate link; said elongate link is securable to said actuation means at any selected one of a plurality of peripherally spaced apart connection points so that a specific position of said lever can correspond to any of a plurality of angular positions of said actuation means; said actuation means comprises a disk coaxial with said horizontal axis and having peripherally spaced apart holes therein; and connection of said elongate link to said actuation means is by means of a pin passing through said elongate link and receivable in a selected one of said holes.

The invention makes it possible to provide exercise apparatus capable of a multiplicity of configurations for carrying out different exercises. A number of features may be included to provide easy selection of these configurations.

Preferably, the exercise apparatus has indicia on said disk for guiding a user to select an appropriate one of said holes to configure said exercise apparatus for use in a particular exercise.

Still further, the actuation means may comprise a plurality of parts that are capable of being placed and held in a plurality of positions relative to each other so as to adapt said exercise apparatus for use in a plurality of exercises.

In a further and most preferred aspect of the invention, there is provided an exercise device comprising:

a handed pair of subframes comprised in a base frame positionable on a floor surface and spaced apart from and symmetrically positioned on opposite sides of a centerline of said base frame and associated with each said subframe an exercise means, wherein each exercise means comprises:

(a) a first movable member;

(b) actuation means arranged to move said first movable member in response to a defined movement of a user of said apparatus;

(c) a second movable member;

(d) resistance generating means for resisting movement of said second movable member;

(e) an elongate cam comprised in one of said first and second movable members and having a shaped cam surface extending between opposing ends of said cam; and (f) a cam follower comprised in the other of said first and second movable members and that in use of said apparatus traverses a path along said shaped cam surface between said opposing ends, so that said user experiences a defined pattern of resistance variation during execution said defined movement said pattern being dependent on the shape of said shaped cam surface.

A user can align himself or herself with the base frame and depending on the configuration operate the left and right apparatus with left and right legs or left and right arms, separately or together.

Preferably, in each said exercise means:

said second movable member is so mounted to said subframe as to be movable along a defined path;

said first movable member comprises a lever pivotably mounted to said subframe; and said actuation means is mounted in bearing means to be pivotable about a horizontal axis and is linked to said first movable member so that pivoting movement of said actuation means pivots said lever, whereby said cam follower traverses said cam surface and said second movable member moves along said defined path responsively to movement of said actuation means.

More preferably, said bearing means of each said exercise means is pivotable about a vertical axis through a right angle between two user selectable operating positions and wherein by choice of said operating positions said horizontal axes of said handed pair members can be positioned coaxially with each other or parallel to each other.

This arrangement has been found to greatly expand the number of configurations and exercise types possible with the device.

The base frame is preferably adapted for attachment thereto of a bench for supporting a user of the exercise device. This may be placed in any one of a plurality of positions so as to adapt said device for use in multiple exercises.

Other possible features and enhancements are disclosed in the following detailed description.

BRIEF DESCRIPTION OF DRAWINGS

FIG. 13 is a Table referred to in the text as Table 1.

DETAILED DESCRIPTION OF DRAWINGS

Figure 1:
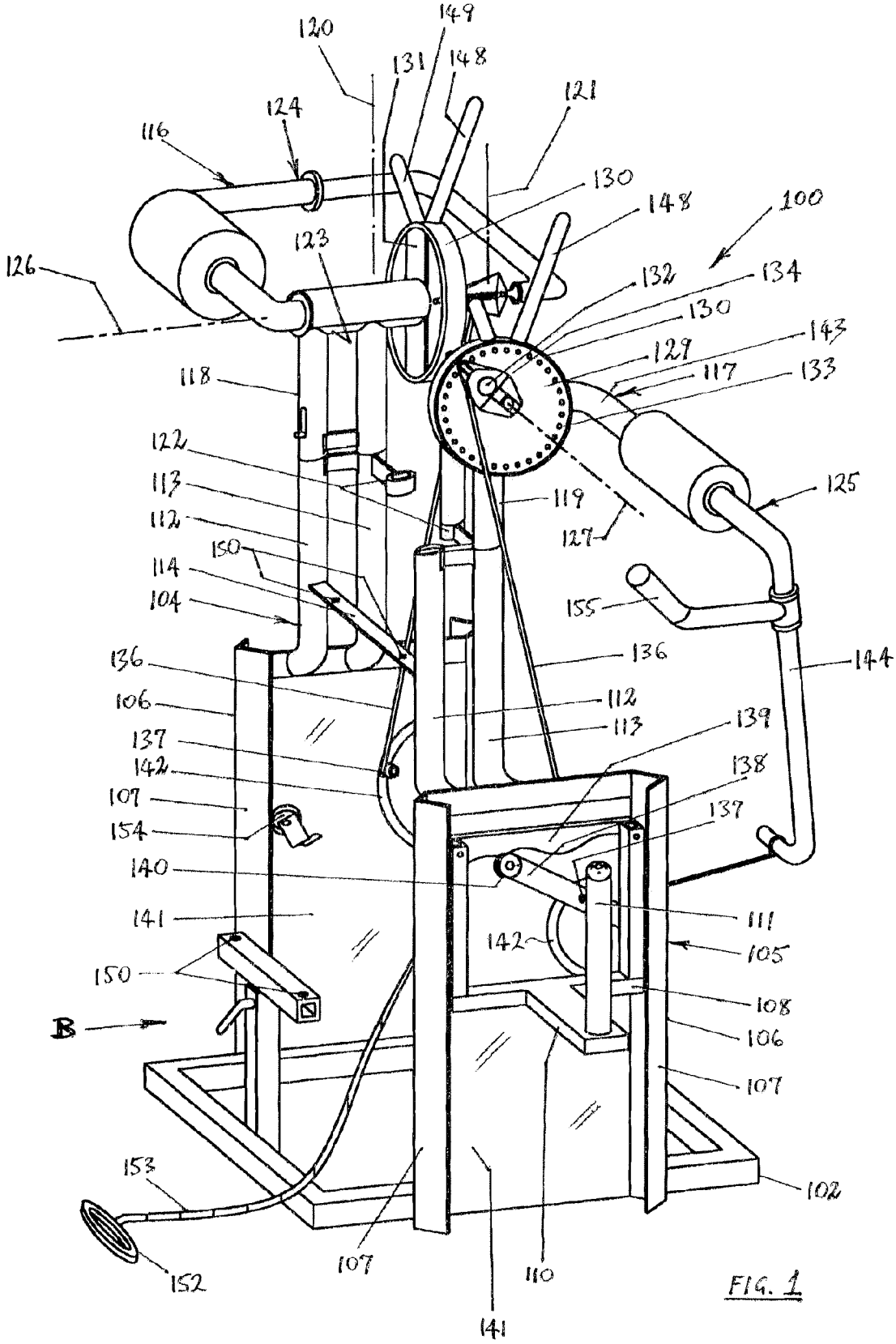
FIG. 1 is a perspective view of an exercise apparatus according to the invention (with a bench accessory omitted)

FIG. 1 shows an exercise apparatus 100 according to the invention. Omitted from this view is one component of apparatus 100, namely a bench 101 for supporting a user. Apparatus 100 includes a base 102 for sitting on a suitable surface such as a floor 103 and generally upstanding left and right side frames 104, 105 respectively. The side frames 104, 105 are a handed pair and have lower sections 106 which include pairs of vertical guides 107 for guiding the vertical movement of weight-supporting trolleys 108. The trolleys 108 have rollers 109 mounted thereto which roll along the guides 107 and ensure that the trolleys 108 are captive in between their respective pairs of guides 107. Each trolley 108 includes a laterally extending part 110 with an upstanding spike 111 over which weight(s) 162 (not shown in FIG. 1) can be placed in known fashion. In use of the apparatus 100, it is the raising and lowering of trolleys 108 and their associated weights that provides the resistance to movement felt by a user, as explained below.

Tubular members 112 and 113 extend upward from the lower sections 106 of side frames 104 and 105. A transverse bar 114 extends between corresponding members 112 to ensure adequate rigidity of apparatus 100. Left and right subassemblies 116 and 117 are supported by tubes 113.

Subassemblies 116 and 117 respectively include frames 118 and 119. Each of frames 118 and 119 includes a downwardly depending pintle 115 which is rotatably received in a tube 113, so that subassemblies 116 and 117 can be rotated about respective vertical axes 120 and 121. Each is lockable by a user in either of two positions, having a depending locking pin (not shown) in an opening in the top of tube 112 or a formation 122 extending inwardly from tube 113. Frames 118 and 119 each include a bearing block 123, and left and right actuation members 124 and 125 are rotatably mounted in the bearing blocks 123 of subassemblies 116 and 117, for rotation about horizontal axes 126 and 127. FIG. 1 shows subassembly 116 locked in a position where the axis 126 of its bearing block 123 extends in a direction hereinafter called the longitudinal direction and subassembly 117 locked in a position where the axis 127 is perpendicular to axis 126, and extends in a direction hereinafter called the transverse direction.

Figure 2:
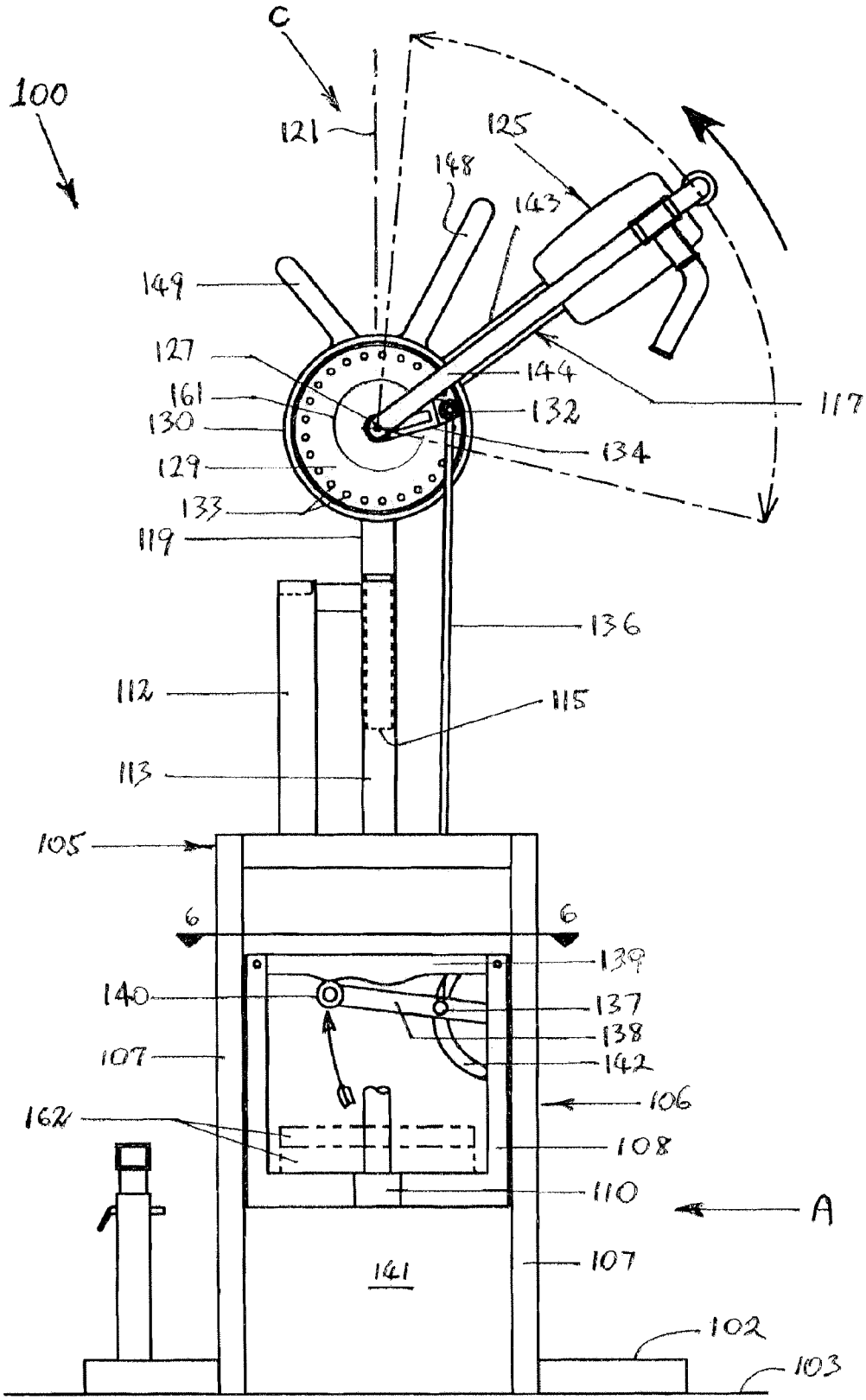
FIG. 2 is a side view of the apparatus shown in FIG. 1, set up in a first particular configuration for use.

Secured to the actuating members 124, 125 and coaxial with axes 126 and 127 are respective selector discs 128 and 129, so that each of discs 128 and 129 and its associated actuation member 124 or 125 will rotate together. Each of the selector discs 128, 129 has 32 parallel equally spaced holes 133 drilled axially at a radius close to its outer edge, and is closely surrounded by a ring member 130 which is rigidly secured to the bearing block 123 by a support member 131. Normally, the machine configuration shown in FIG. 1 is not used in practice. Instead both axes 126 and 127 are arranged to be either parallel and in the longitudinal direction (see FIG. 4) or co-axial and extending in the transverse direction (see FIG. 2, FIG. 3). The particular arrangement shown in FIG. 1 simply shows how subassemblies 118 and 119 can be rotated about their upright axes 120 and 121

Associated with each selector disc 128 and 129 is a user-movable pin 132 which can extend axially into any chosen one of the holes 133. Pins 132 are supported in frames 134 which can rotate freely about the rotation axes 126 or 127 of the associated disc 128 or 129. Cables 136 are secured pivotally at their upper ends to respective pins 132. Cables 136 extend downwardly to pivots 137 on arms 138. Arms 138 are pivotally mounted to respective side frame lower sections 106. When an exercising user moves an actuation member, 125 say, the disc 129 secured to disc 129 is accordingly caused to rotate. Its cable 136 therefore transmits movement to the associated arm 138. This movement is resisted by the weight of the associated trolley 108 and any weights 162 thereon, transmitted downwardly by an elongate cam 139 secured to trolley 108 through a roller 140 on arm 138 which thus acts as a cam follower. As arm 138 pivots, roller 40 traverses along cam 139.

Note that cables 136 at their upper end are not wrapped around their respective selector discs 128, 129. Rather, their upper ends follow a path that is circular due to the pin 132 being anchored in one of the holes 133 but the cable 136 remains straight and, in general, not tangential to the pitch circle of the holes 133. This arrangement has an advantage over conventional "wraparound" resistance arrangements wherein a cable with a similar function to the cable 136 is wrapped around a cam or drum of varying radius. It has been found that in both of the two possible positions of each sub assembly 116, 117 it is possible to have a cable 136 run directly from the selector pin 132 to pivot 137 on arm 138 without interference with surrounding parts of the structure. This is more difficult to achieve with more conventional arrangements.

The mechanism including arm 138, roller 140 and cam 139 provides for modulation of the resistance felt by the user of the apparatus in moving the actuating members 124, 125. The side frames 104 and 105 include respective back plates 141 for protection of users of apparatus 100 from interference with moving parts and the presence of back plates 141 requires that pivot 137 passes through an arcuate slot 142 in the back plate 141. Roller 140 rolls on the underside of cam 139, which is secured to trolley 108. Depending on the shape of the edge of the cam 139 along which roller 140 runs during its normal movement, there will be modulation of the tension in the cable and accordingly of the resistance felt by the user to the particular type of movement of the actuation member 124 or 125. This modulated or varying resistance during a repetition of an exercise can be provided without any requirement to move large weights sideways as well as vertically and without use of the more usual arrangement of a cable wrapped around a cam shaped drum. A surprising advantage is that the cam 139 can be quite small in its linear extent. This is because the amount of travel of the roller 140 relatively along cam 139 need not be particularly large.

If cam 139 was simply a straight bar without the shaped lower edge shown, there would still be a degree of variation of resistance felt by a user simply through the general arrangement of the mechanism. However, by suitably shaping the cam 139, it is possible to provide more and/or different variation as required.

Turning to the use of apparatus 100 for a range of exercises, a number of settings are made for different exercises. Firstly, the user can choose either the parallel and longitudinal positions of the disc axes 126, 127 or the co-axial, transverse axis positions. Secondly, and as will be described further below, the user chooses a particular hole 133 in each of discs 128 and 129 to select the orientation of the actuation members 124, 125. Different exercises will in general require different orientations of the actuation members 124 and 125 to the frame 102.

Figure 7:
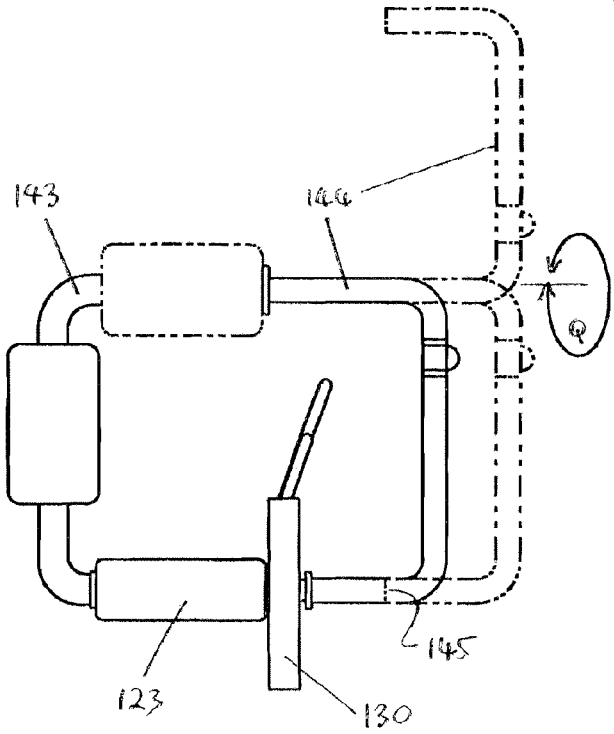
FIG. 7 is a partial view of the apparatus shown in FIG. 2, looking in the direction of arrow "C" in FIG. 2 with some alternative arrangements also shown in phantom outline.

Thirdly, of course, the weights 162 added to trolleys 108 are a matter of choice. Fourth, different exercises require different configurations of the actuation members 124, 125. These can be seen in FIG. 1, FIG. 7 and FIG. 8. Taking actuation member 125 as an example, member 125 consists of two U-shaped tubular parts 143 and 144. Part 143 is pivotally mounted in bearing block 123. One end of part 144 is telescopically received in an opening 145 in part 143, as shown In FIG. 7 (solid lines). The other end mates with a boss 146 on disc 129. Thus, parts 143 and 144 rotate as a unit.

However, a different arrangement is possible in which parts 143 and 144 of actuation member 125 are partially separated, as shown in FIG. 1 and (in phantom lines) FIG. 7. Part 144 is held telescoped within part 143 by a coil spring (not shown) which is located inside part 143 and connected to part 144. However, if the part 144 is pulled axially away from part 143, it can at one end remain telescopically received in part 143 but at the other end it can be withdrawn from boss 146. Part 144 can then be rotated about axis "Q" as shown in FIG. 7.

Figure 8:
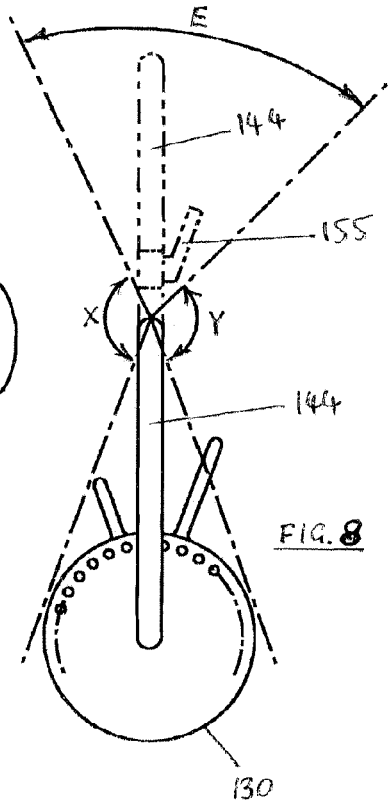
FIG. 8 is a schematic end elevation of the parts shown in FIG. 7.

A certain form of movement about axis "Q" is desirable for achieving a range of exercises. FIG. 8 shows the approximate ranges within which part 144 can rotate about axis Q with this arrangement. In the range marked "E" the part 144 is free to rotate, but is constrained to lie between the ends of the range. This is achieved by (providing) the telescoping end of part 144 with a shaped recess (not shown) which engages with a pin (not shown) in part 143. However, if the part 144 is pulled out a little further that engagement can be broken also, and part 144 can rotate within the ranges marked "X" and "Y" as well. However, if rotation in those ranges happens to lead to the part 144 re-entering range E, part 144 will become restricted to range E again. Regions X and Y are limited by contact between part 144 and ring 130, as shown.

Figure 9:
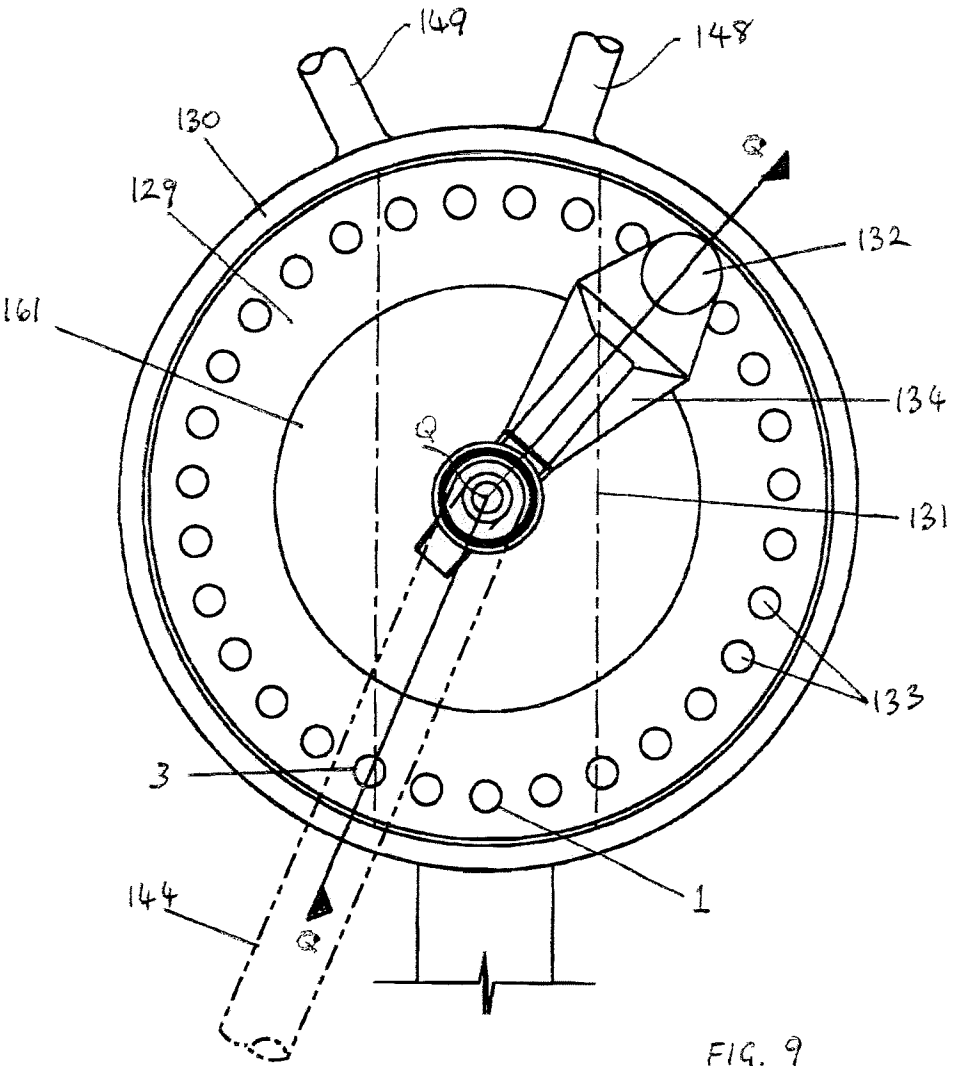
FIG. 9 is an end elevation of a part of the apparatus shown in FIG. 1.
Figure 10:
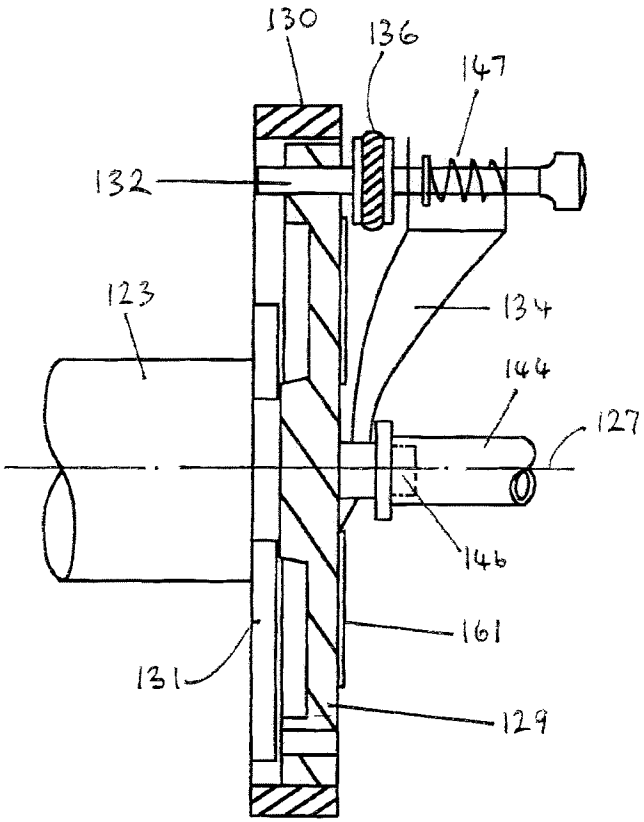
FIG. 10 is a cross-sectional view of the part shown in FIG. 9, taken at Station "QQQ" In FIG. 9.

FIG. 9 and FIG. 10 show parts of the sub assembly 117, namely disc 129, the ring 130 surrounding disc 129, the bearing block 123 and the pin 132 for connecting cable 136 to disc 129. Pin 132 is captive in frame 134 in such a way that withdrawal axially from disc 129 requires compression of a spring 147. That is, there is a bias towards keeping of the pin 132 in the selected hole 133. Pin 132 can, if required, be withdrawn far enough to remove it altogether from disc 129. Because frame 134 is able to rotate freely about the axis 127 and independently of disc 129, any of the 32 holes may be chosen. In practice, with 32 holes used on a selector disc of apparatus 100, only about 12 will in fact lead to useful exercises. However this is in no sense intended to be a limitation on the scope of the invention as claimed.

The view in FIG. 9 also shows (in phantom outline) part 144 of the actuation member 125. In this view, it is shown in the position it occupies when pushed anticlockwise as far as it can go. The hole numbered 1 then lies directly underneath axis 127, with the hole numbered 3 being in line with the second part of the actuation member. The holes are numbered to increase in clockwise direction for sub assembly 117 and in the opposite direction for sub assembly 116. (Other hole positions and numbering can be used without departing from the invention, but this particular hole numbering accords with the information in Table 1, discussed below.)

Secured to the face of the disc 129 is a disc 161 suited to take printing or writing and on which it is possible to write the names of particular types of exercises so that instead of selecting a (hole 133) number, one can select an exercise type by name. This is believed to be a novel feature in itself. As will be apparent from FIG. 10, pin 132 is long enough to extend through disc 129 far enough that it can bear against the member 131 which supports the ring 130. Member 131 is shown in phantom outline in partial section in FIG. 10. Thus, member 131 automatically limits the range of movement that can be obtained from the actuation member 125. Member 131 is in fact preferably proportioned to ensure that appropriate ranges are in fact obtained. Recesses (not shown) may be cut or formed in edges of member 131 to extend the allowable range in a particular direction if needed. Some exercises will involve pin 132 remaining on the right hand side of member 131 and some on the left, as seen in FIG. 9.

Figure 4:
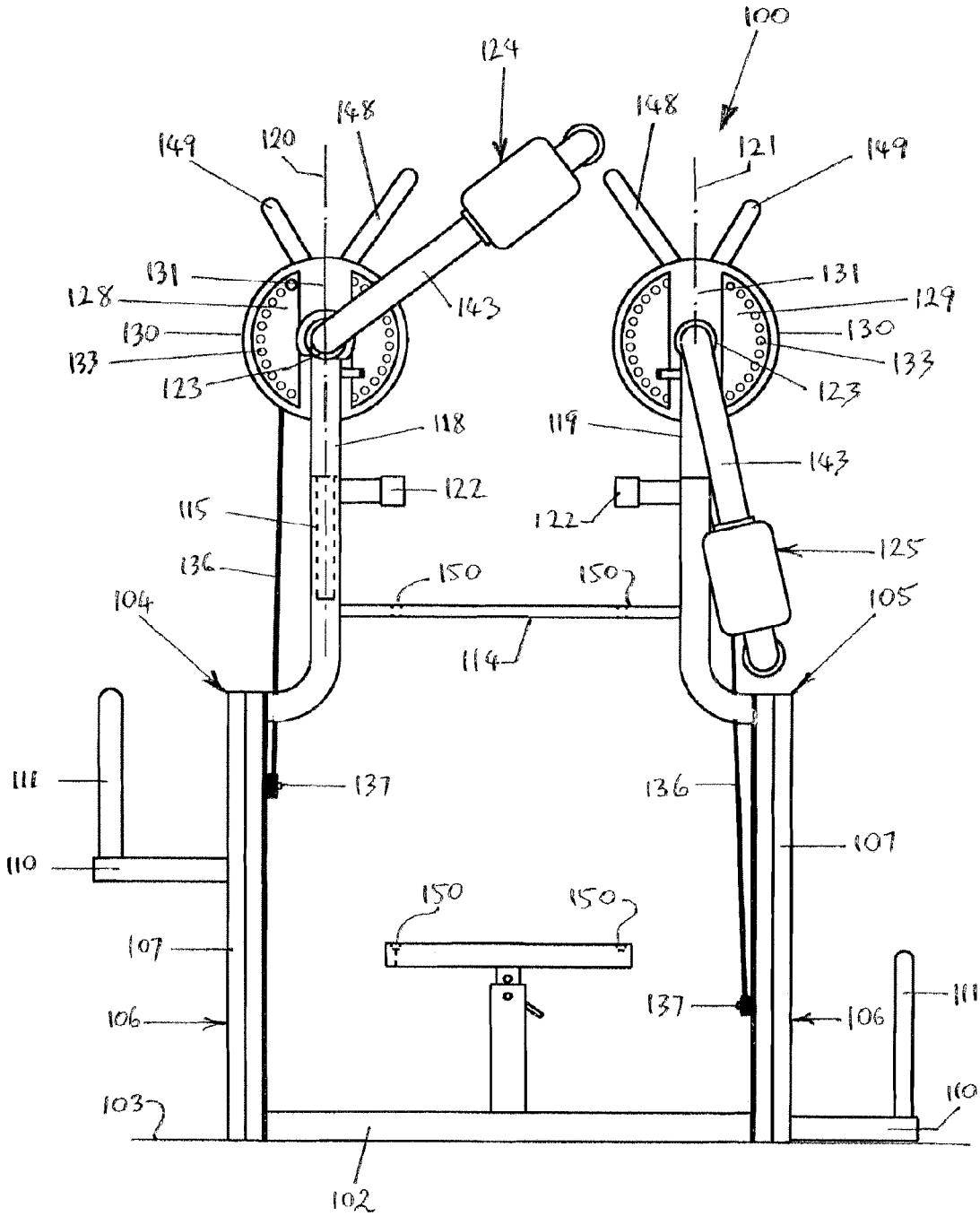
FIG. 4 is an end elevation of the apparatus shown in FIG. 1, looking in the direction of arrow "B" in FIG. 1, set up in a second particular configuration different from the configuration shown in FIG. 3.

It is possible for pin 132 inadvertently to be pushed axially through the selected hole 133 by an amount insufficient for it to engage upon member 131 to provide a stop function. This has potential to create a safety hazard. Referring to FIG. 4, there is shown an in view of apparatus 100 with the sub assemblies 116, 117 positioned so as to have their axes 126 and 127 parallel to each other. The positions of the two actuation members 124 and 125 are shown as being different, not because this is a practical situation but in order to show the limits of travel obtainable for the actuation members 124, 125. Actuation member 125 is shown in its most extreme clockwise position, where further movement is stopped by contact between it and the side frame 105. Actuation member 124 is also shown in its most extreme clockwise position, where it impacts with one of two stops 148 secured to rings 130. The corresponding extreme position for actuation member 125 would occur when contact takes place between member 125 and the opposite stop 148. In certain exercises, the stops 148 are in fact useful as handles. The stop function provided by stops 148 will always be present even if the pin 132 is inadvertently not inserted to full depth.

Each ring 130 is also provided with a further stop 149. When the two sub assemblies 116 and 117 are in the positions in which their rotation axes 126 and 127 extend transversely, the formations 148 and 149 are so located that it is convenient to place the bar of a bar bell (not shown) between them and sitting on the two rings 130. When the bench 101 is in use, as discussed below, a user is thus able to use bar bell-type free weights. This further enhances the versatility of apparatus 100.

Figure 5:
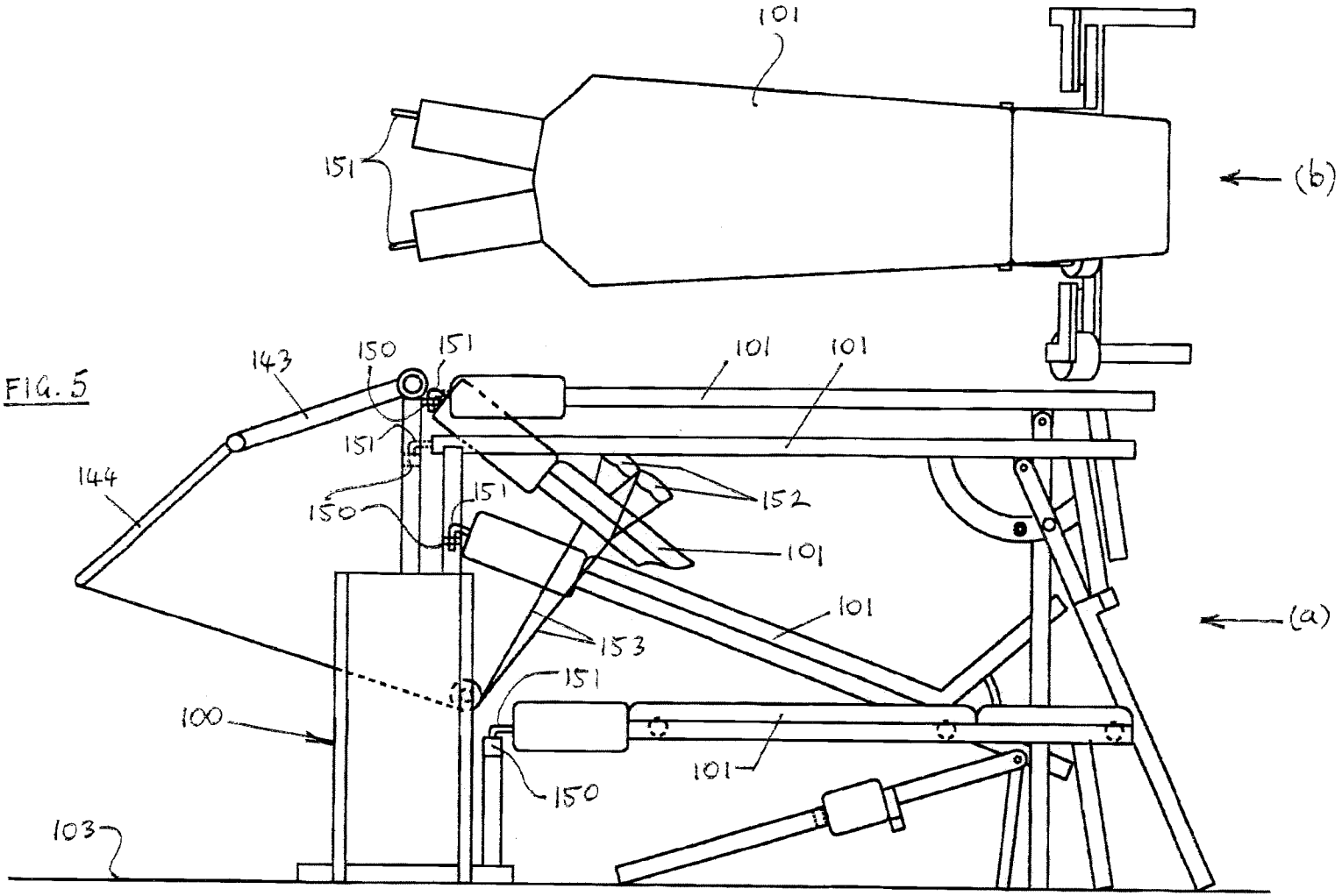
FIG. 5(*a*) is a side view (with some mechanical details omitted) of the exercise apparatus shown in FIG. 1 set up in third and fourth particular configurations, with a bench accessory component shown in five different possible positions, and FIG. 5(*b*) is a top view of the bench accessory component.
Figure 6:
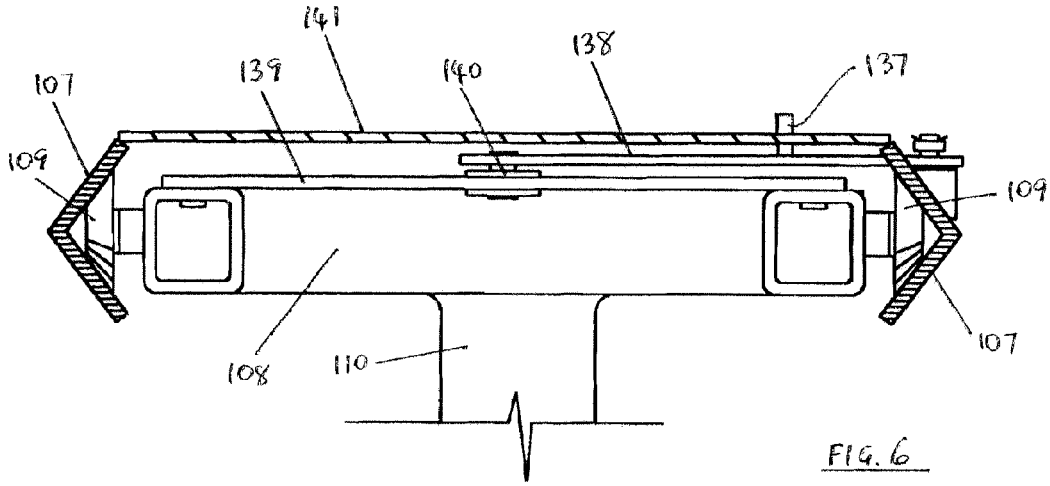
FIG. 6 is a cross sectional view of a part of the apparatus shown in FIG. 2, taken at station "6-6" in FIG. 2.

FIG. 5 shows at (a) a side view of apparatus 100 with much mechanical detail omitted for clarity. Apparatus 100 is provided with four separate sets of points 150 for receiving hook-like projections 151 on the end of a relocatable bench 101. Five possible positions of bench 101 are shown in FIG. 5 simply superimposed on each other so that it is in effect schematic only. The horizontal positions shown are labeled "high", "medium" and "low" for reference in the attached table.

FIG. 5 also shows how the apparatus 100 can provide for exercising in which the user lies on the (now-angled) bench 101 on his or her back and pulls handles 152 forward which are attached to ropes 153 offering resistance to movement. For this exercise to be carried out, it is necessary to disengage parts 144 of members 124 and 125 and place them in the limited-travel range (E) previously discussed. Then, to each of parts 144 one of ropes 153 is secured extending over sheaves 154 secured to side frames 104, 105 and to handles 152.

Apparatus 100 can provide a large number of possible exercise types. At least some of these are set out in the attached Table 1 (FIG. 13). Each row in the table corresponds to one exercise. The columns set out how the machine is to be set up to achieve the exercise in question. There are columns for bench position, sub assembly (116, 117, termed "floating mount") rotation, hole (133) selection, the side of member 137 on which pin 132 is locked, whether the actuation members 124, 125 are fully telescoped ("Arm extension") and whether the parts 144 are able to rotate. In addition, the table notes when it becomes convenient or necessary to use hand grips 155 that are freely rotatably mounted to parts 144 of members 124, 125. Still further, the table notes when the formations 148 and 149 (described in the Table as "V Pins") are to be used as handles by the user. Finally, the body position of the user on the apparatus is given. This is only a selection of the exercises able to be carried out using apparatus 100.

Furthermore, there is the ability to change the nature of the resistance met by the user in each exercise. This can be done by installation of a suitable linear cam 139 for each exercise. It will be noted that the linear cam 139 shown in FIG. 12 has one straight edge 180. This enables the cam 139 to be mounted upside down, so that the only modulation or variation or resistance felt by the person exercising is associated with the general proportions of the mechanism, and not variations on top of that due to the shaped surface 181 of cam 139. This approach to obtaining variable resistance in an exercise machine is very convenient.

Figure 11:
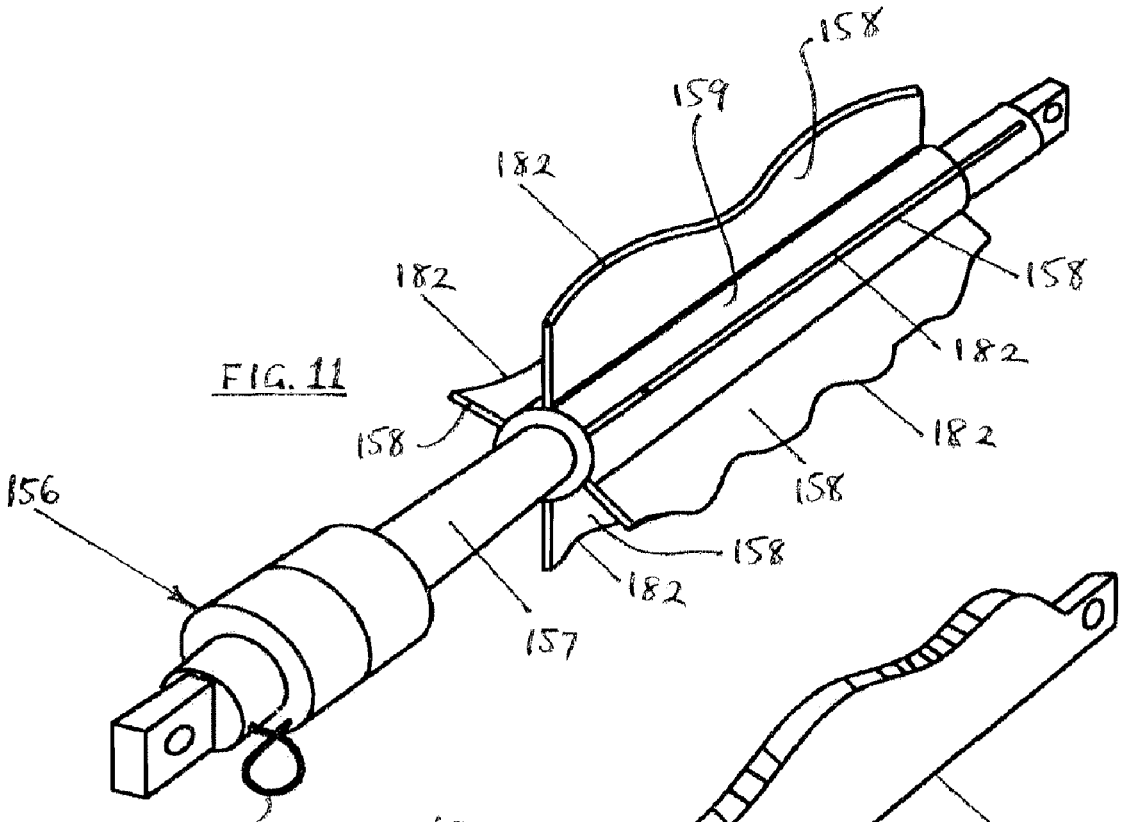
FIG. 11 is a perspective view of a rotary cam assembly for use in the apparatus shown in FIG. 1.
Figure 12:
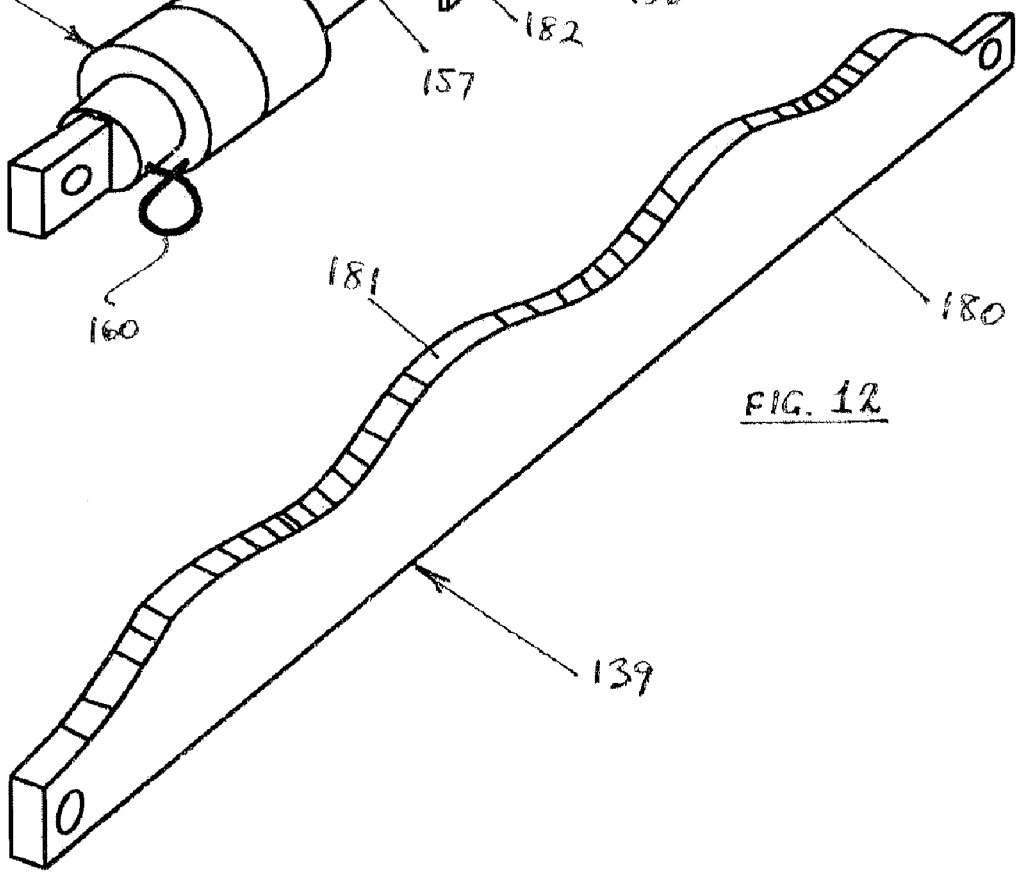
FIG. 12 is a perspective view of a cam used in the apparatus shown in FIG. 1.

FIG. 11 shows a cam assembly 156 which is able to be simply substituted for the linear cam 139 shown in FIG. 12. It will be noted that cam assembly 156 has the same end fixing details as linear cam 139. However, instead of a single plate with a shaped surface providing the cam effect, cam assembly 156 has a central shaft 157 with a number (in this case six, of which five are visible in FIG. 11) of radially extending cam members 158. Each cam member 158 has a differently shaped camming surface 182. The cam members 158 are mounted to a tube 159 that can be placed in a range of rotational positions by removing and replacing a pin 160 with the required cam surface 182 lowermost. This makes the selection of a cam profile from a small number of cam profiles an easy matter.

Many variations may be made without exceeding the spirit and scope of the invention.

Figure 3:
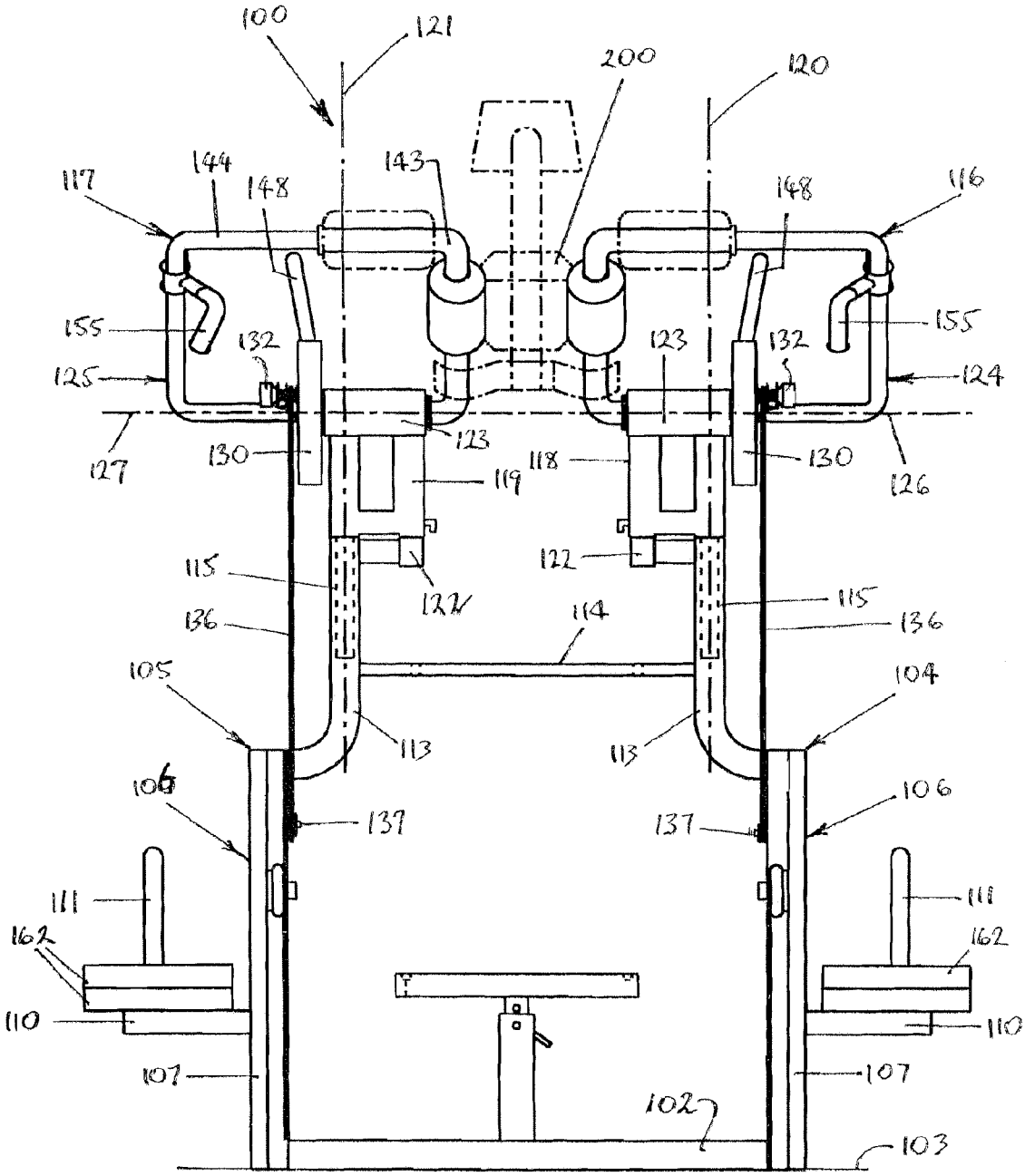
FIG. 3 is an end elevation of the apparatus and configuration shown in FIG. 2, looking in the direction of arrow "A" in FIG. 2.

For example, an accessory leg squat unit 200 can be provided, which is adapted to be connected to both actuation members 124 and 125, and between them, so that they move together as a single unit. The leg squat unit 200, shown in phantom outline in FIG. 3, gives a larger circumference of movement and also links both actuation members together to double resistance on the leg being exercised.

The invention claimed is:

1. An exercise apparatus comprising:

a frame;

a first movable member comprising a lever pivotably mounted to said frame;

actuation means mounted in bearing means so as to be pivotable about a horizontal axis of said bearing means in response to a defined movement of a user of said apparatus and linked to said first movable member so that pivoting movement of said actuation means pivots said lever; and a second movable member comprising a carriage movable up and down along a path defined by linear guides comprised in said frame and adapted to be loaded with weights, wherein:

said second movable member comprises an elongate cam having a shaped cam surface extending between opposing ends of said cam and secured to said lever is a cam follower that in response to said defined movement of said actuation means contacts and traverses said shaped cam surface so that:

(a) said second movable member moves along said path defined by said guides; and (b) the combined weight of said carriage and said weights loaded thereon is supported by said cam follower whereby said user experiences a defined pattern of resistance variation during execution of said defined movement said pattern being dependent on the shape of said shaped cam surface.

2. The exercise apparatus of claim 1 wherein said shaped cam surface is non-linear.

3. The exercise apparatus of claim 1 wherein said actuation means is linked to said lever by an elongate link and wherein said elongate link is securable to said actuation means any selected one of a plurality of peripherally spaced apart connection points so that a specific position of said lever can correspond to any of a plurality of angular positions of said actuation means.

4. The exercise apparatus of claim 3 wherein said actuation means comprises a disk coaxial with said horizontal axis and having peripherally spaced apart holes therein, and wherein connection of said elongate link to said actuation means is by means of a pin passing through said elongate link and receivable in a selected one of said holes.

5. The exercise apparatus of claim 4 having indicia on said disk for guiding a user to select an appropriate one of said holes to configure said exercise apparatus for use in a particular exercise.

6. The exercise apparatus of claim 1 wherein said actuation means comprises a plurality of parts that are capable of being placed and held in a plurality of positions relative to each other so as to adapt said exercise apparatus for use in a plurality of exercises.

7. The exercise apparatus of claim 1 wherein said bearing means is so mounted to said frame as to be rotatable about a vertical axis between two selectable positions and lockable in either of said two positions for use of the exercise apparatus.

8. An exercise apparatus comprising a handed pair of exerciser means symmetrically positioned on opposite sides of a centerline of a base frame positionable on a floor surface wherein:

(a) each exerciser means comprises: a first movable member comprising a lever pivotably mounted to a subframe mounted to said base frame; actuation means mounted in bearing means so as to be pivotable about a horizontal axis of said bearing means in response to a defined movement of a user of said apparatus and linked to said first movable member so that pivoting movement of said actuation means pivots said lever; and a second movable member comprising a carriage movable up and down along a path defined by linear guides comprised in said frame and adapted to be loaded with weights, (b) for each said exerciser means said second movable member comprises an elongate cam having a shaped cam surface extending between opposing ends of said cam and secured to said lever is a cam follower that in response to said defined movement of said actuation means contacts and traverses said shaped cam surface so that said second movable member moves along said path defined by said guides; and the combined weight of said carriage and said weights loaded thereon is supported by said cam follower whereby said user experiences a defined pattern of resistance variation during execution of said defined movement said pattern being dependent on the shape of said shaped cam surface.

9. The exercise apparatus of claim 8 wherein:

(a) for each said exercise means said bearing means is so mounted to its said subframe as to be rotatable about a vertical axis between two selectable positions and lockable in either of said two positions for use of said exercise apparatus; and (b) said selectable positions of said bearing means are such that said bearing means can in use be selected to have their said horizontal axes parallel to each other and to said centerline or coaxial with each other.

10. The exercise apparatus of claim 8 wherein a bench for a user is securable in any of a plurality of positions to said subframes.

* * * * *